US011191400B2

(12) United States Patent
Lopez

(10) Patent No.: US 11,191,400 B2
(45) Date of Patent: Dec. 7, 2021

(54) TOILET ASSIST DEVICE

(71) Applicant: VIVE HEALTH LLC, Naples, FL (US)

(72) Inventor: Juan Lopez, Naples, FL (US)

(73) Assignee: Vive Health LLC, Naples, FL (US)

( * ) Notice: Subject to any disclaimer, the term of this patent is extended or adjusted under 35 U.S.C. 154(b) by 0 days.

(21) Appl. No.: 16/793,868

(22) Filed: Feb. 18, 2020

(65) Prior Publication Data

US 2021/0251442 A1 Aug. 19, 2021

(51) Int. Cl.
*A47K 17/02* (2006.01)

(52) U.S. Cl.
CPC ..... *A47K 17/026* (2013.01)

(58) Field of Classification Search
CPC ..... A47K 17/026
USPC ..... 4/254, 185; 297/391, 411.2, 423.1
See application file for complete search history.

(56) References Cited

U.S. PATENT DOCUMENTS 3,011,179 A * 12/1961 Hussey ..... A47K 17/026 4/254
4,685,157 A * 8/1987 James ..... A47K 17/026 4/254
4,794,653 A * 1/1989 Strasser ..... A47K 17/026 285/22
4,833,736 A * 5/1989 Sadler ..... A61G 7/1007 4/254
4,884,841 A * 12/1989 Holley ..... A61G 5/14 297/331
4,894,871 A * 1/1990 Schmerler ..... A47K 17/026 135/67
4,924,531 A * 5/1990 Square ..... A47K 17/022 297/DIG. 10
D336,682 S * 6/1993 Francke ..... D23/309
5,309,583 A * 5/1994 White ..... A61G 7/1007 297/DIG. 10
5,365,621 A * 11/1994 Blain ..... A61G 7/1017 5/83.1
5,380,034 A * 1/1995 Wilson ..... A61G 5/006 280/30
5,517,704 A * 5/1996 Dagostino ..... A47K 3/122 4/480
5,561,872 A * 10/1996 Phillips ..... A61G 7/1007 4/254
5,687,431 A * 11/1997 Garrett ..... A47K 17/02 4/237
5,787,515 A * 8/1998 Mason ..... A47K 17/026 297/217.7

(Continued)

FOREIGN PATENT DOCUMENTS

CN 304979120 1/2019

OTHER PUBLICATIONS

U.S. Appl. No. 29/658,199, filed Jul. 30, 2018, Lopez.

(Continued)

*Primary Examiner* — Lori L Baker
(74) *Attorney, Agent, or Firm* — Workman Nydegger

(57) ABSTRACT

A toilet assist device that has handles, handle legs, and two support bars. One of the support bars may be attached and detached from the toilet assist device as desired. The toilet assist device may be customized to meet the height and width requirements of specific users. The toilet assist device may be attached to a toilet.

20 Claims, 4 Drawing Sheets

(56) References Cited

U.S. PATENT DOCUMENTS

| | | | | | |
|---|---|---|---|---|---|
| 5,819,325 | A * | 10/1998 | Richards | A61G 7/1017 | 4/237 |
| 5,944,338 | A * | 8/1999 | Simpson | A61G 5/006 | 280/650 |
| 5,971,476 | A * | 10/1999 | Gibson | A47D 13/02 | 297/183.4 |
| 6,030,039 | A * | 2/2000 | Essler | A47C 15/008 | 128/845 |
| 6,206,019 | B1 * | 3/2001 | Horvitz | A61H 3/00 | 135/66 |
| 6,449,783 | B1 * | 9/2002 | Moser | A47K 13/10 | 4/254 |
| 6,453,921 | B1 * | 9/2002 | Rost | A61H 3/00 | 135/67 |
| 7,373,942 | B1 * | 5/2008 | Yeager | A61H 3/00 | 135/67 |
| D675,332 | S | 1/2013 | Tinder | | |
| D675,744 | S * | 2/2013 | Gomizelj | D24/188 | |
| 8,402,572 | B2 * | 3/2013 | Herasimtschuk | A47K 17/026 | 4/254 |
| D690,431 | S | 9/2013 | Nohr | | |
| D721,440 | S | 1/2015 | Pursel | | |
| 8,936,033 | B2 * | 1/2015 | Velarde | A61H 3/00 | 135/67 |
| 9,554,961 | B1 * | 1/2017 | Juarez | A43B 5/0419 | |
| 9,622,934 | B2 | 4/2017 | Wilson | | |
| D803,997 | S * | 11/2017 | Bodman | D23/309 | |
| D885,584 | S * | 5/2020 | Lopez | D24/188 | |
| 10,653,576 | B1 * | 5/2020 | Song | A47K 13/10 | |
| 10,835,433 | B2 * | 11/2020 | Schwab | A61G 7/1007 | |
| 2006/0131840 | A1 * | 6/2006 | Donay | B62B 7/123 | 280/642 |
| 2008/0121258 | A1 * | 5/2008 | Lin | A61H 3/00 | 135/67 |
| 2012/0304801 | A1 * | 12/2012 | L'Ecuyer | B62K 23/06 | 74/523 |
| 2012/0312861 | A1 * | 12/2012 | Gurumurthy | A61B 90/94 | 227/177.1 |
| 2014/0109943 | A1 * | 4/2014 | Fang | A61H 3/00 | 135/67 |

OTHER PUBLICATIONS

Amazon. Portable Couch Standing Aid for Seniors by STAND A ROO-NO Assembly Required-Stand Assist for Elderly, Disabled and Expecting Mothers—Medical Grade Materials. No date specified. https://amazon.com-Stand-Roo-SAR2001-Double-Adjustable/dp/B073XN3YH9?th=1 (Year: 0)

Ebay. Standing Handle Assist for Adults Elders Couch Grab Rail PWD Chair Sofa Aid. May 10, 2019. https://ebay.com/itm/Standing-Handle-Assist-for-Adults-Elders-Couch-Grad-Rail-PWD-Chair-Sofa-Aid-/254123723414 (Year: 2019)

Amazon. Vive Stand Assist—Mobility Standing Aid Rail for Couch & Chair—Assistance Handle for Patients, Elderly, Seniors & Disabled—Safety Grab Bar for Sitting, Sofa & Home—Adjustable & Portable Device. No date specified. https://amzn.to/2KbtHO4 (Year: 0)

U.S. Appl. No. 29/658,199, Dec. 9, 2019, Final Office Action.

U.S. Appl. No. 29/658,199, Aug. 20, 2019, Non-Final Office Action.

U.S. Appl. No. 29/658,199, Feb. 24, 2020, Notice of Allowance.

U.S. Appl. No. 29/724,692, filed Feb. 2020, Lopez.

U.S. Appl. No. 29/724,692, filed Jan. 11, 2021, Notice of Allowance.

* cited by examiner

TOILET ASSIST DEVICE

BACKGROUND

Technical Field

The present disclosure relates generally to support devices. More specifically, the present disclosure relates to stability devices that can be used with toilets.

Related Technology

Advanced age, permanent or temporary disability, scores of muscle diseases, and many other problems can render an individual unable to perform everyday tasks. Specifically, with respect to aging: muscles deteriorate, flexibility decreases, and the pain associated with each of the aforementioned increases. While some people can afford costly assistance from third parties to overcome these problems and perform everyday tasks, many cannot. For those who cannot, having reliable support devices can be critical. Examples of support devices include walkers, canes, bathtub bars, benches, wheelchairs, and anything else that helps someone perform daily tasks. These devices make otherwise overwhelming daily tasks manageable. For those who have a hard time sitting down and standing up, using the bathroom can be extremely cumbersome, and in some cases impossible. Indeed, in extreme cases, having a reliable bathroom stability device is the difference between independent living and transitioning to an assisted living facility or skilled nursing center.

Universal bathroom stability devices can be helpful to those who struggle to use the toilet, but they are not always ideal. For example, universal bathroom stability devices may not fit around nonstandard toilets, leaving them unusable to persons owning the same. Similarly, if a person travels out of town and takes her stability device along for the trip, the toilet in her hotel may be a different size than the toilet at home. In a two-person household where both persons need the assistance of the support device, a universal support device may not suffice as it will only offer adequate support for one of the users. For example, where one spouse is six feet tall with long legs and significant girth and the other spouse is five feet tall with shorter legs and less girth, a universal support device likely will not accommodate both spouses at the same time. If tailored to the weight and height of the smaller spouse, the support device may be too short and narrow for the larger spouse. Likewise, if customized to the weight and height of the larger spouse, the support device may not provide an advantage to the smaller spouse, as it may be too wide or tall to provide appropriate support. An adjustable support device, adjustable for both height and width, is needed in this circumstance.

Accordingly, there are many disadvantages with support devices that can be addressed.

BRIEF SUMMARY

Implementations of the present disclosure solve one or more of the foregoing or other problems in the art with systems, methods, and apparatuses for stability when using the toilet. In particular, one or more implementations can include a toilet assist device that has handles, handle legs, and two support bars. One of the support bars may be detachable and storable. The toilet assist device can additionally include tips, wheels, length adjustment mechanisms, a mounting plate, and locking joints.

An exemplary toilet assist device has first and second handles configured to be grasped by, and support, the user. At least a portion of the first and second handles may reside on first and second handle legs. The toilet assist device further comprises a first support bar and a second support bar. The second support bar is detachable and configured to reside generally in front of the toilet bowl when the toilet assist device is in use.

In one aspect, the handles of the toilet assist device lie on top of at least a portion of either the first or second handle legs and have a finger depression.

In one aspect, the toilet assist device has interchangeable tips and wheels that may be attached to the handle legs. The handle legs can also be adjusted using a length adjustment mechanism.

In one aspect, the first and second support bars lie generally perpendicular to the handle legs of the toilet assist device.

Accordingly, toilet assist devices are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope.

In the drawings, multiple instances of an element may each include separate letters appended to the element number. For example, two instances of a particular element "100" may be labeled as "100*a*" and "100*b*." In that case, the element label may be used without an appended letter (e.g., "100") to generally refer to every instance of the element, while the element label will include an appended letter (e.g., "100*a*") to refer to a specific instance of the element. Similarly, a drawing number may include separate letters appended thereto. For example, FIG. 2 may include FIG. 2A and FIG. 2B. In that case, the drawing number may be used without the appended letter (e.g., FIG. 2) to generally refer to every instance of the drawing, while the drawing label will include an appended letter (e.g., FIG. 2A) to refer to a specific instance of the drawing. The disclosure will be described and explained with additional specificity and detail through the use of the accompanying drawings in which.

DETAILED DESCRIPTION

Figure 1:
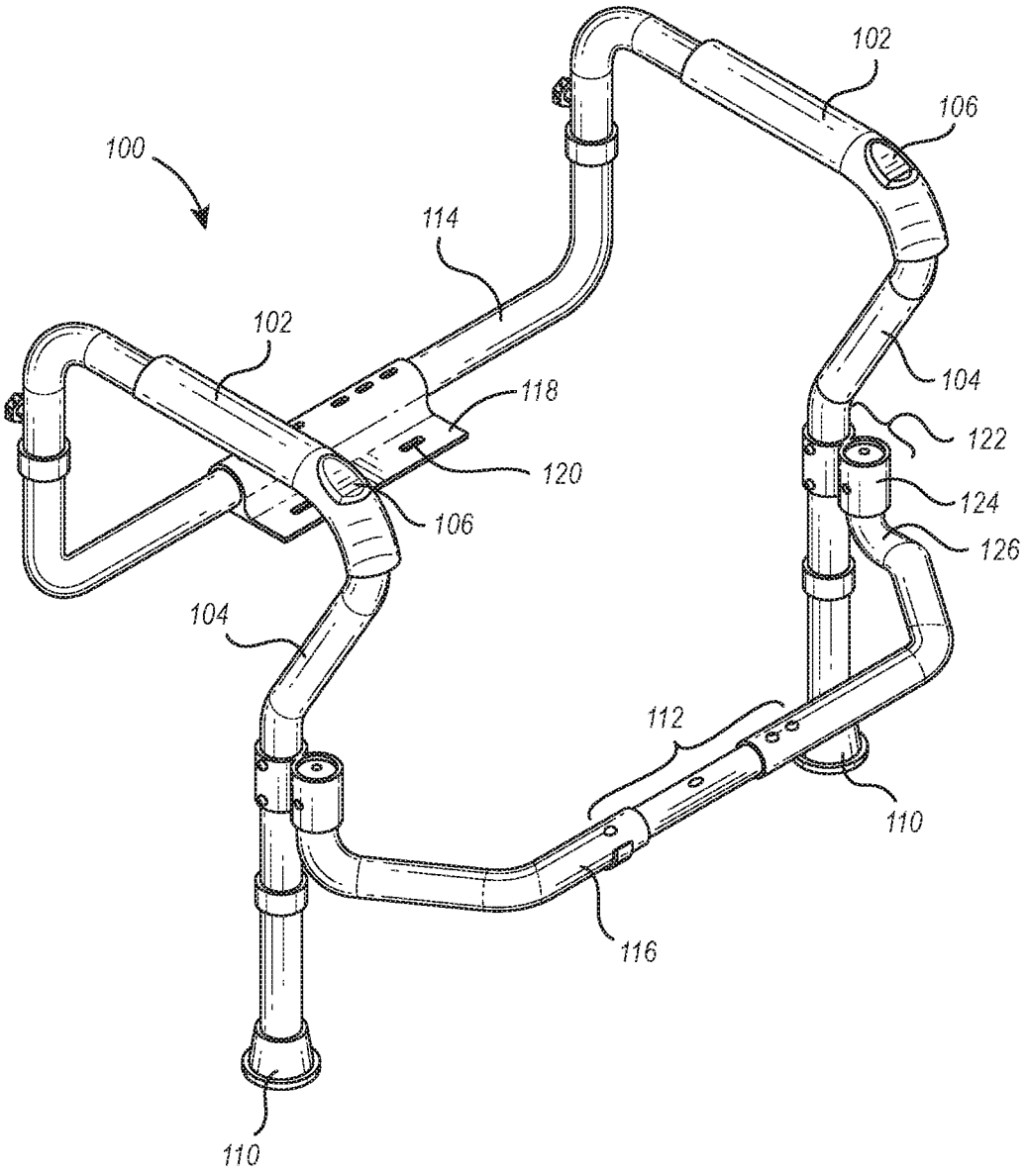
FIG. 1 illustrates a front perspective view of a toilet assist device, according to one or more embodiment of the present disclosure.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise.

In addition, unless otherwise indicated, numbers expressing quantities, constituents, distances, or other measurements used in the specification and claims are to be understood as being modified by the term "about," as that term is defined herein. Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

Any headings and subheadings used herein are for organizational purposes only and are not meant to be used to limit the scope of the description or the claims.

Overview of Toilet Assist Devices

As briefly discussed above, muscle deterioration can affect anyone. It can be caused by permanent or temporary disability, various muscles diseases, poor exercise habits, and many other problems. During moments of incapability or lack of mobility, certain tasks that seem simple on a normal, healthy day, may become difficult. Tasks like using the toilet. Bending over to sit on the toilet is difficult when muscles are weak or joints ache. Getting up from the toilet can be likewise difficult and, in some cases, impossible. If two differently sized persons in a two-person household both suffer from muscle soreness, the problems are exacerbated. Two of every support device will have to be purchased, otherwise one of the people will be forced to use a support device customized to the other.

Embodiments of the present disclosure provide customizable stability to toilet users and solve one or more problems in the art of toilet assist devices. A toilet assist device as described herein is customizable to multiple users and provides mobility and/or stability when needed. Advantageously, the tools disclosed herein may include handles, handle legs, and two support bars. Additionally, the toilet assist device can be adaptable for alternative use to enable operation in a variety of ways to further assist those struggle with stiffness or other mobility issues, thereby enabling an individual to more easily navigate and accomplish their everyday tasks, particularly going to the bathroom.

Abbreviated List of Defined Terms

To assist in understanding the scope and content of the foregoing and forthcoming written description and appended claims, a select few terms are defined directly below.

The term "attachment mechanism," as used herein, includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some embodiments, the attachment mechanism may be an integral part of a component, whereas in other embodiments, the attachment mechanism may be separate.

An attachment mechanism is to be understood to have any number of movable and/or fixed parts, any of which may be singularly or in combination with one or more components interact to facilitate attachment. As non-limiting examples, an attachment mechanism may include a mechanism for attaching components using one or more—or a combination of—chemical adhesives (e.g., an epoxy and/or other thermosetting adhesives, glue, cement, paste, tape and/or other pressure-sensitive adhesives, etc.), mechanical fasteners (e.g., threaded fasteners such as a combination of a threaded rod together with a complementary threaded nut, rivets, screws, clamps, buckles, tenon and mortise pairs, hook and loop fasteners, dual lock reclosable fasteners, cable ties, rubber bands, etc.), magnets, vacuums (e.g., suction cups, etc.), and/or interference fittings (e.g., press fittings, friction fittings, etc.). Additionally, or alternatively, an attachment mechanism may include any material or element resulting from physically attaching two or more components by crimping, welding, and/or soldering.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," "involves," "contains," etc.), and similar terms as used herein, including within the claims, shall be inclusive and/or open-ended, shall have the same meaning as the word "comprising" and variants thereof (e.g., "comprise" and "comprises"), and do not exclude additional un-recited elements or method steps, illustratively.

It will be noted that, as used in this specification and the appended claims, the singular forms "a," "an" and "the" include plural referents unless the context clearly dictates otherwise. Thus, for example, reference to a singular referent (e.g., "widget") includes one, two, or more referents. Similarly, reference to a plurality of referents should be interpreted as comprising a single referent and/or a plurality of referents unless the content and/or context clearly dictate otherwise. For example, reference to referents in the plural form (e.g., "widgets") does not necessarily require a plurality of such referents. Instead, it will be appreciated that independent of the inferred number of referents, one or more referents are contemplated herein unless stated otherwise.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible. Specific language will be used herein to describe the exemplary embodiments. Nevertheless, it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Any headings used herein are for organizational purposes only and are not meant to be used to limit the scope of the description or the claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

Although the subject matter described herein is provided in language specific to structural features and/or methodological acts, it is to be understood that the subject matter defined in the appended claims is not necessarily limited to the described features or acts so described. Rather, the described features and acts are disclosed as example forms of implementing the claims.

Toilet Assist Device

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments. While the various aspects of the embodiments are presented in drawings, the drawings are not necessarily drawn to scale unless specifically indicated.

The toilet assist device described herein can be used as a stability device to assist users in using the toilet, or as a stability device for any other task as needed. The disclosed embodiments are particularly useful for individuals who may have weak muscles or other physical ailments that prevent them from easily sitting or standing.

An exemplary toilet assist device 100 of the present disclosure is illustrated in FIG. 1.

The toilet assist device 100 may include two handle legs 104 that extend to the ground (e.g., ground 140, see FIG. 6) from the handles 102. The handle legs 104 may be coupled to, or integrated with, the handles 102. The handle legs 104 may contact the ground at a position nearly behind where the user's feet touch the ground when using the toilet. Alternatively, the handle legs 104 may contact the ground at a position nearly adjacent to where the user's feet touch the ground when using the toilet. The handle legs 104 may be the shape shown in FIG. 1 or any other shape that allows them to contact the ground. The handles 102 may be made of a grippy material with a high coefficient of friction such that the user's hands will not be harmed by the handles 102 but also will not slip when the user relies on the toilet assist device 100 to sit down on, or get up from, the toilet. The handles 102, which are configured to be grasped by a user, may extend at an angle from the handle legs 104 toward the anticipated position of the user's hands when sitting on the toilet. Alternatively, as shown in FIG. 1, a handle 102 may lie on top of a portion of a handle leg 104. In such an embodiment there may be additional surface area for the user to grab when he or she wants to sit down on, or get up from, the toilet. Although FIG. 1 shows a certain portion of the handles 102 lying on top of the handle legs 104, it should be appreciated that any portion, or no portion at all, of the handles 102 may lie on top of the handle legs 104. Additionally, the handles 102 may be rotatable such that they may lie on top of the handles legs 104 or on bottom of the handle legs 104. Handles 102 may be a uniform shape with distinct ends as shown in FIG. 1, or may be irregular with indistinct ends. The distal ends of the handles 102 may include a finger depression 106 for placement of the user's thumb or other finger when using the toilet assist device 100. The finger depression 106 may assist the user when sitting down on, or arising from, the toilet by providing a comfortable location for the user to focus at least a portion of his or her weight when sitting down on, or arising from, the toilet. As is also shown in FIG. 1, finger depression 106 may include grooves to provide further stability when the user places his or her hand on handle 102 and finger depression 106.

Figure 2A:
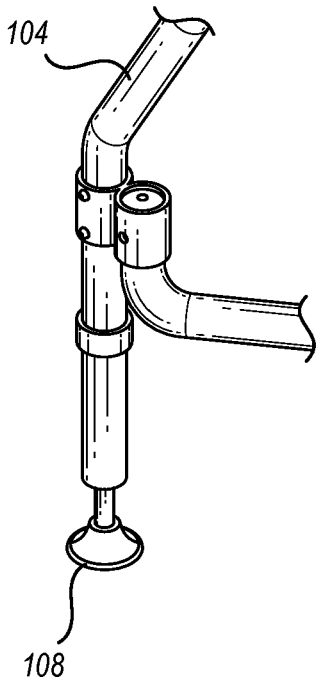
FIGS. 2A and 2B illustrate close-up views of a handle leg, attachment mechanism, suction cup, and wheel of a toilet assist device, according to one or more embodiment of the present disclosure.
Figure 2B:
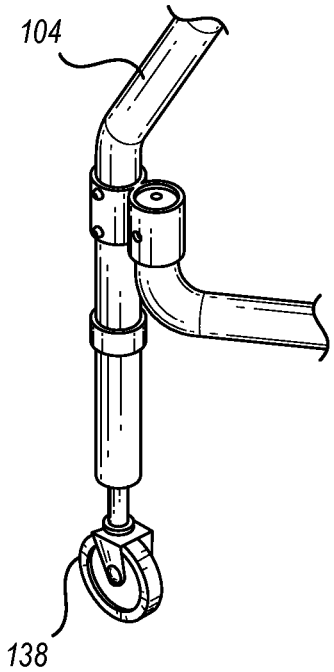

Additional details of an embodiment for a toilet assist device 100 are also illustrated in FIG. 1. Tips 110 may be coupled to the distal end of the handle legs 104. Tips 110 may be made of any nonslip material such that the toilet assist device 100 will not slip when the user applies force as he or she sits down on, or gets up from, the toilet. Exemplary nonslip materials include but are not limited to neoprene, polyethylene, sponge rubber, silicone foam, urethane, cork, rubber, felt, acrylic, and polyester. FIG. 1 shows tips 110 as a generally circular shape and of a sturdy, non-flexible material. However, in some embodiments tips 110 may be other shapes and sizes, including rectangular, square, etc. While FIG. 1 shows tips 110 made of a sturdy, non-flexible material, tips 110 may also be made of pliable, flexible material. In addition, as shown in FIG. 2, toilet assist device 100 may alternatively include suction cups 108, which are made of flexible, soft rubber that is impenetrable by air. In such an embodiment, suction cups 108 generally have a concave area under the nose or head of the cup for naturally trapping air and creating a vacuum. The air outside the cup then pushes against the outside of the suction cup which in turn presses the perimeter of the cup against the floor or other surface. Advantageously, suction cups 108 may provide added stability by allowing toilet assist device 100 to stick to the floor or other surface on which toilet assist device 100 is used.

Figure 3:
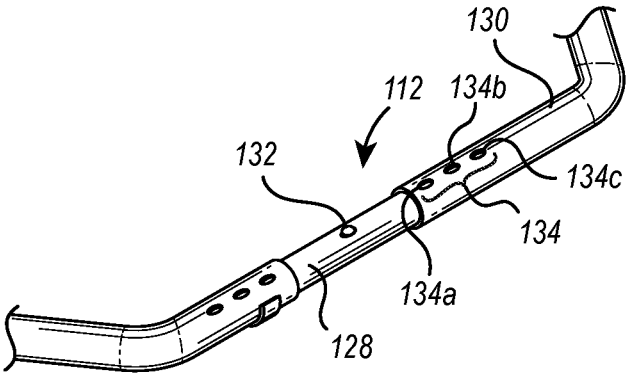
FIG. 3 illustrates a close-up view of a telescoping length adjustment mechanism on second support bar, according to one or more embodiment of the present disclosure.

FIG. 3 shows an exemplary length adjustment mechanism 112 which allows a user to increase the length of a given member of the toilet assist device 100. FIG. 3 shows the length adjustment mechanism used in connection with the second support bar 116 and is discussed in further detail below. However, length adjustment mechanism 112 may also be used with any of the other members of the toilet assist device 100, such as handle legs 104. Each of the handle legs 104 may include a length adjustment mechanism 112 to allow a user to increase the length of the handle legs 104 and thereby adjust the height of the handles 102. Although FIG. 3 shows length adjustment mechanism 112 oriented such that holes 134*b* face up, length adjustment mechanism 112 may be oriented such that holes 134*b* face any number of directions, including down. This also applies to the length adjustment mechanism 112 when used in connection with the second support bar 116. It may be oriented in any direction needed.

Referring again to FIG. 1, the toilet assist device 100 may further comprise a first support bar 114 and second support bar 116. First support bar 114 and second support bar 116 may lie generally perpendicular to handle legs 104 and the user's toilet. In this way first support bar 114 and second support bar 116 provide lateral stability to toilet assist device 100 when in use. Alternatively, first support bar 114 and second support bar 116 may lie in other orientations with respect to handle legs 104 and the user's toilet, so long as their orientation provides stability to the user when using the toilet. First support bar 114 and second support bar 116 may be made of any rigid material, such as metal or plastic. As shown in FIG. 1, in some embodiments first support bar 114 may be positioned toward the posterior end of the toilet assist device 100 and second support bar 116 may be positioned toward the anterior end thereof. However, it should be appreciated that first support bar 114 may be positioned toward the anterior end of the toilet assist device and second support bar 116 may be positioned toward the posterior end of the toilet assist device.

First support bar 114 may further comprise a mounting plate 118. As is known by one of skill in the art, mounting plate 118 may comprise locking joints 120 for securing the toilet assist device 100 to the user's toilet. While FIG. 1 shows mounting plate 118 having two locking joints 120, any number of locking joints 120 are included within the scope of the invention. A bolt, screw, or other rigid member may be used to secure locking joint 120, and thereby mounting plate 118, to the user's toilet. As is shown in FIG. 1, first support bar 114 may be generally U-shaped. Alternatively, first support bar 114 may be any other shape that provides stability to the user as he or she sits down on, or stands up from, the toilet. For example, first support bar 114 may be triangular to take advantage of the structural elements of a triangular setup, or first support bar 114 may any other suitable shape. Additionally, toilet assist device 100 may include additional support bars as needed to provide adequate support to the user when using the toilet. For example, toilet assist device 100 may include two distinct support bars in the place of first support bar 114 or second support bar 116. Or toilet assist device may include a third support bar or fourth support bar as desired.

Figure 6:
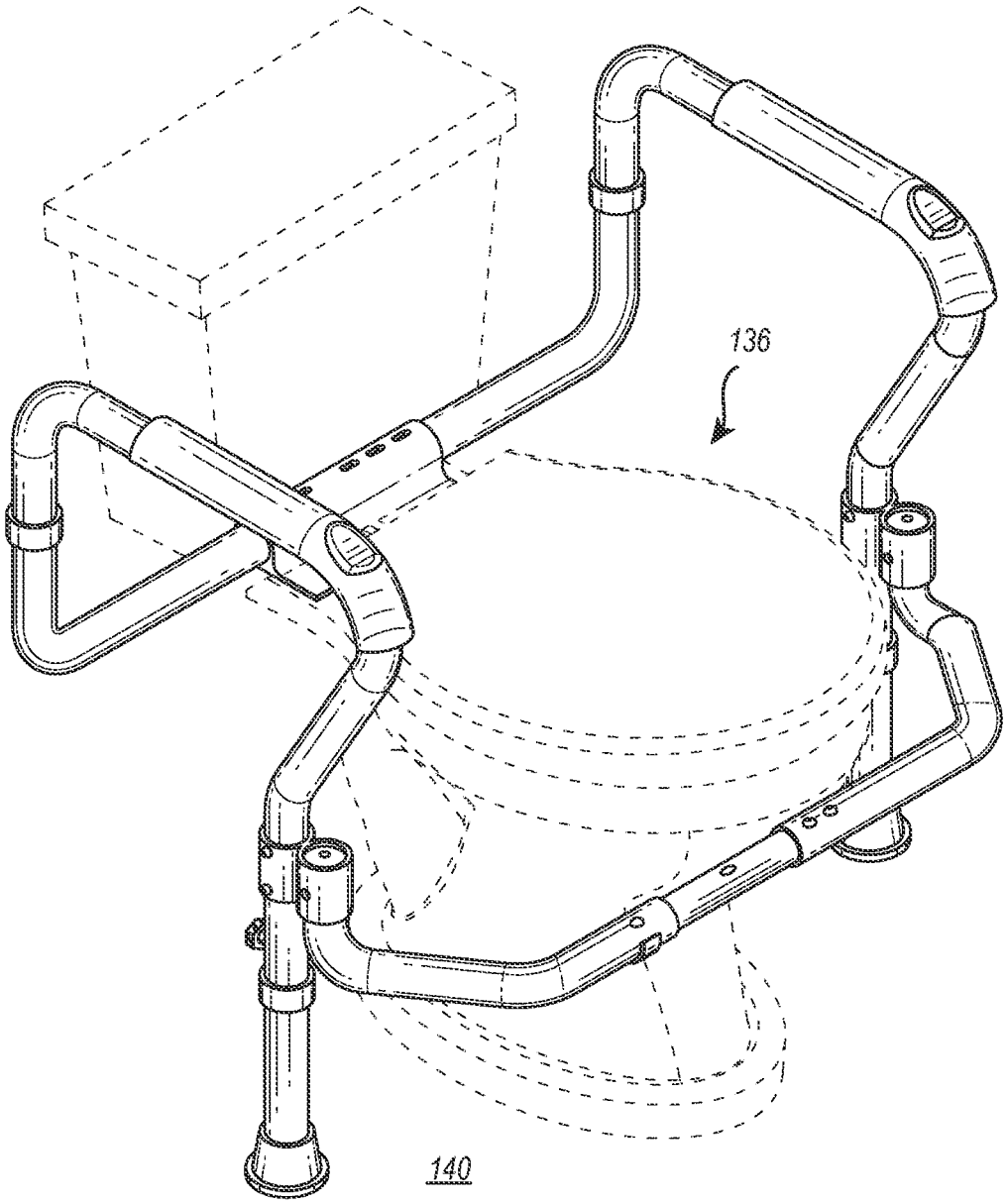
FIG. 6 illustrates a front perspective view of a toilet assist device showing the device in relation to a toilet, according to one or more embodiment of the present disclosure.

As shown in FIG. 6, second support bar 116 may be configured to reside generally in front of the toilet bowl of a toilet 136 when the toilet assist device is in use. For example, as shown in FIG. 1, second support bar 116 may connect to handle legs 104 by attachment mechanism 122. Attachment mechanism 122 may comprise housing 124 for selectively receiving and holding end 126 of second support bar 116. Housing 124 may selectively receive and hold end 126 of second support bar 116 by any suitable method, including a snug fit, Velcro or other hook and loop fastener, and male and female attachments. Further, by enabling the separation of second support bar 116 via the attachment mechanism 122, second support bar 116 can be removed from the toilet assist device 100, thereby making both second support bar 116 and toilet assist device 100 easier to move and/or store. Further, with second support bar 116 removed, toilet assist device 100 can be utilized for more individualized needs. For example, removing second support bar 116 allows toilet assist device 100 to be maneuvered more agilely and can be an aid to a user in more or different situations (e.g., when sitting, when walking). This selective attachment of second support bar 116 via attachment mechanism 122 also allows a user to move the toilet assist device 100 using wheels 138 (see FIG. 2B) and then attach second support bar 116 once seated at the toilet. By doing so the user may enjoy the full mobility and stability features of toilet assist device 100 as he or she desires and needs.

Figure 5:
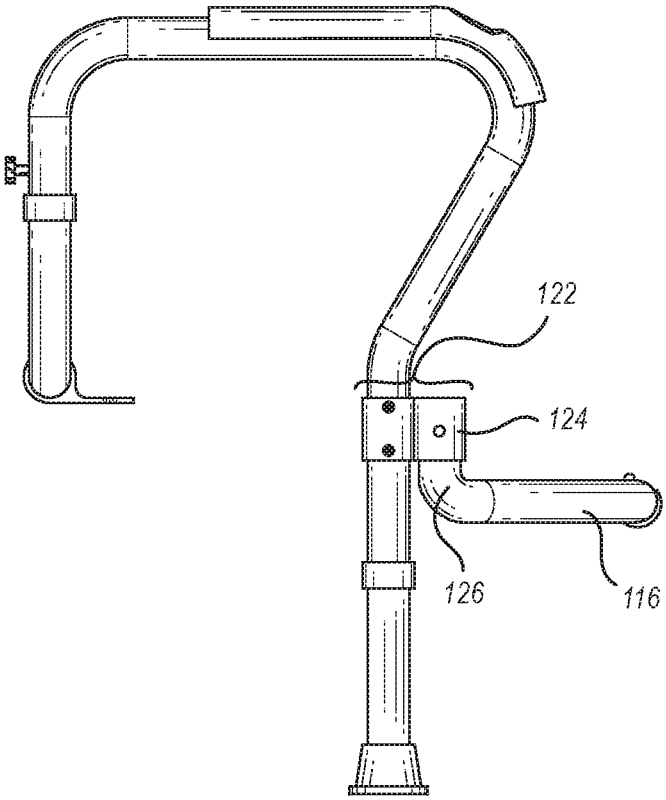
FIG. 5 illustrates a left side elevation view of a toilet assist device, according to one or more embodiment of the present disclosure.

As shown in FIG. 5, attachment mechanism 122 and second support bar 116 may be configured to reside at an elevation relatively below first support bar 114. Such an arrangement may be beneficial to the user to allow her to sit down at the toilet with second support bar 116 in place. Alternatively, attachment mechanism 122 and second support bar 116 may be configured to reside at an elevation relatively above first support bar 114. Such an arrangement may be beneficial if the user desires an arm rest while using the toilet. In such a situation, the user may wait to attach second support bar 116 until after he or she sits down to use the toilet so as to not impede his or her ability to sit down at the toilet.

Second support bar 116 may further comprise a telescoping length adjustment mechanism 112, as shown in detail in FIG. 3, and discussed in greater detail below.

Figure 4:
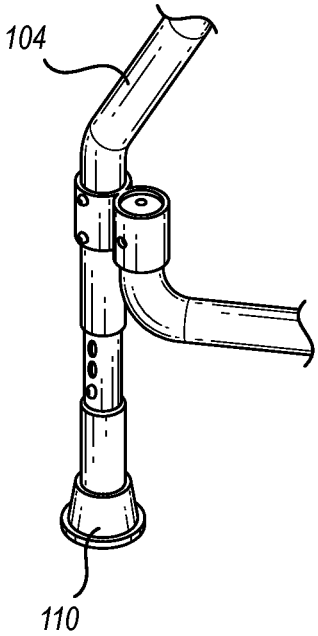
FIG. 4 illustrates a close-up view of telescoping length adjustment mechanism on a handle leg, according to one or more embodiment of the present disclosure.

FIGS. 3 and 4 are close-up perspective views of one embodiment of a telescoping length adjustment mechanism 112, which may optionally be used on the handle legs 104 and/or second support bar 116. FIG. 3 shows a telescoping length adjustment mechanism on second support bar 116. FIG. 4 shows a telescoping length adjustment mechanism on a handle leg 104. But it can be appreciated that the telescoping length adjustment mechanism 112 may also be used as described herein with first support bar 114 or other members of the toilet assist device 100 that may need quick length adjustment.

Referring now to FIGS. 3 and 4, telescoping adjustment mechanism 112 may comprise a telescoping tube 128, shaft 130, button 132, and plurality of aligned holes 134. While FIGS. 3 and 4 show a single button 132 and three holes 134*a*, 134*b*, and 134*c*, it can be appreciated that any number of buttons 132 and plurality of aligned holes 134 are within the scope of the invention. The telescoping tube 128 may be at least partially received within and slidably moveable relative to a longitudinal axis of shaft 130. The button 132 may be depressed by the user such that button 132 slides underneath shaft 130 until it engages with the first hole 134*a* of the plurality of aligned holes 134, thereby securing the telescoping tube 128 relative to the shaft 130 and achieving a specific width for the anterior end of toilet assist device 100. As the telescoping tube 128 is moved in a direction toward the third hole 134*c*, i.e., inserted further within shaft 130, the length is shortened, thereby reducing the width of the anterior portion of toilet assist device 100. If the user desires to further shorten the width of the anterior portion of the toilet assist device 100, he may keep the button 132 depressed until it slides past the first hole 134*a* and into the second hole 134*b* or third hole 134*c*. The plurality of aligned holes 134 may be spaced along a length of shaft 130. The telescoping adjustment mechanism 112, including telescoping tube 128, shaft 130, and button 132, may be formed of any rigid material, such as plastic or metal. While FIGS. 3 and 4 show button 132 and plurality of aligned holes 134 circular in shape, it should be understood they may be of any shape as long as the shape of button 132 and the shape of each hole in the plurality of aligned holes 134 are the same such that button 132 may engage with each hole in the plurality of aligned holes 134. Further, while FIGS. 3 and 4 show the plurality of aligned holes 134 equidistant from each other, they may be spaced at irregular intervals in the event such spacing is desired.

CONCLUSION

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A toilet assist device, comprising:

first and second handles configured to be grasped by, and support, a user;

first and second handle legs, each of the first and second handle legs comprising a respective attachment mechanism;

a first support bar; and a second support bar configured to reside generally in front of a toilet bowl when the toilet assist device is in use, wherein the second support bar is selectively attachable to the respective attachment mechanisms of the first and second handle legs to facilitate selective separation of the second support bar from the toilet assist device.

2. The toilet assist device of claim 1, wherein the second support bar also resides at an elevation generally below the elevation of the first support bar.

3. The toilet assist device of claim 1, wherein each of the first and second handles lie on top of a portion of either the first or second handle legs.

4. The toilet assist device of claim 1, wherein each of the first and second handles further comprise a grooved finger depression.

5. The toilet assist device of claim 1, further comprising tips coupled to the handle legs.

6. The toilet assist device of claim 5, wherein the tips are generally circular in shape.

7. The toilet assist device of claim 1, further comprising wheels coupled to the handle legs.

8. The toilet assist device of claim 1, further comprising interchangeable tips and wheels, either of which may be coupled to the handle legs.

9. The toilet assist device of claim 1, wherein the first and second handle legs each further comprise a length adjustment mechanism.

10. The toilet assist device of claim 1, wherein the first and second support bars lie generally perpendicular to the handle legs.

11. The toilet assist device of claim 1, wherein the second support bar connects to the handle legs via an attachment mechanism.

12. The toilet assist device of claim 1, wherein the first support bar further comprises a mounting plate.

13. The toilet assist device of claim 1, wherein the second support bar further comprises a telescoping length adjustment mechanism.

14. A toilet assist device, comprising:

first and second handles configured to be grasped by, and support, a user;

first and second handle legs extending downward from the first and second handles, respectively;

a posterior first support bar, wherein the posterior support bar lies generally perpendicular to at least a portion of the first and second handle legs; and an anterior support bar, wherein the anterior support bar is configured to reside generally in front of a toilet bowl when the toilet assist device is in use and lies generally perpendicular to at least a portion of the first and second handle legs, wherein the first handle leg comprises:

a first end connected to the first handle; and a second end configured to rest on a ground when the toilet assist device is in use, wherein the second end is horizontally offset toward the posterior support bar relative to the first end when the toilet assist device is in use.

15. The toilet assist device of claim 14, further comprising interchangeable tips and wheels, either of which may be coupled to the handle legs.

16. The toilet assist device of claim 15, wherein the anterior support bar connects to the handle legs via an attachment mechanism.

17. A toilet assist device, comprising:

a first support bar, wherein the first support bar lies generally perpendicular to first and second handle legs and further comprises a length adjustment mechanism; and a second support bar, wherein the second support bar is configured to reside generally in front of a toilet bowl when the toilet assist device is in use, lies generally perpendicular to the first and second handle legs, and further comprises a length adjustment mechanism, the adjustment mechanism being configured to adjust along a longitudinal axis of a shaft of the second support bar, the longitudinal axis of the shaft being angularly offset from a longitudinal axis of at least one other section of the second support bar.

18. The toilet assist device of claim 17, further comprising the first and second handle legs.

19. The toilet assist device of claim 18, wherein the first and second handle legs each further comprise a length adjustment mechanism.

20. The toilet assist device of claim 18, wherein the second support bar connects to the handle legs via an attachment mechanism, and wherein the shaft of the second support bar is anteriorly offset from the first and second handle legs.

* * * * *